US005248217A

United States Patent [19]

Smith

[11] Patent Number: 5,248,217

[45] Date of Patent: Sep. 28, 1993

[54] PROCESS FOR FORMING NOTCHES IN AN IRRIGATION LATERAL

[76] Inventor: Don P. Smith, P.O. Box 857, Safford, Ariz. 85548

[21] Appl. No.: 933,773

[22] Filed: Aug. 24, 1992

[51] Int. Cl.[5] ..... E02B 23/00

[52] U.S. Cl. ..... 405/36; 33/286; 33/290; 33/DIG. 21; 172/4.5; 404/84.1; 405/118; 405/268

[58] Field of Search ..... 405/39, 104, 118, 119, 405/36, 303, 268; 404/84.05, 84.1, 75, 2, 4, 108; 33/DIG. 21, 274, 281, 285, 286, 290; 172/DIG. 1, DIG. 14, DIG. 20; 356/153, 152, 141

[56] References Cited

U.S. PATENT DOCUMENTS

| | | | |
|---|---|---|---|
| 281,133 | 7/1883 | Pontious | 33/290 |
| 433,697 | 8/1890 | Reichenbach | 33/290 |
| 3,410,094 | 11/1968 | Shelley | 405/39 |
| 3,775,929 | 12/1973 | Roodvoets et al. | 33/286 X |
| 3,813,171 | 5/1974 | Teach et al. | 172/4.5 X |
| 4,471,530 | 9/1984 | Kirven | 33/286 X |
| 4,681,439 | 7/1987 | Shoemaker | 356/154 |
| 4,718,171 | 1/1988 | Schlemmer et al. | 33/290 |
| 4,764,051 | 8/1988 | Whitney | 404/2 X |
| 4,891,888 | 1/1990 | De Bree et al. | 33/DIG. 21 |

FOREIGN PATENT DOCUMENTS

| | | | |
|---|---|---|---|
| 584016 | 10/1958 | Italy | 404/84.1 |
| 310968 | 8/1971 | U.S.S.R. | 404/84.1 |

*Primary Examiner*—Dennis L. Taylor

[57] ABSTRACT

A process for forming notched irrigation laterals uses a construction laser adapted to propagate radiation along a planar path, and a device that both detects the radiation and is used to manually form notches in the lateral. The laser is positioned relative to the longitudinal axis of the lateral so as to minimize optical interference during the formation process.

3 Claims, 2 Drawing Sheets

PROCESS FOR FORMING NOTCHES IN AN IRRIGATION LATERAL

TECHNICAL FIELD

The present invention relates generally to methods for forming irrigation ditches (hereinafter, "laterals"). More specifically, the invention relates to formation processes for concrete laterals. Still more specifically, the invention relates to a process for forming notches in the freeboard of such laterals.

BACKGROUND OF THE INVENTION

A notched irrigation lateral is illustrated in U.S. Pat. No. 3,410,094 Shelley. Such laterals are preferable to conventional laterals for reasons recited therein. While the use of irrigation ditches is generally limited to areas characterized by dry climate, it is believed that the use of notched irrigation laterals is at present limited to a specific area in the southwestern United States. The prior art is therefore believed to be rather limited, and the above-cited patent is the only pertinent publication of which I am aware.

SUMMARY OF THE INVENTION

The invention is a process for forming notches of common depth in an uncured freeboard of an irrigation lateral, and comprises the steps of positioning a laser device adapted to propagate radiation along a substantially planar path so that the path is at an angle of about ninety degrees relative to the direction of a gravitational vector determined at the location of the device, the device being positioned such that the longitudinal axis of the lateral is located between the freeboard and the device; activating the device to propagate the radiation along the path; and depressing a rigid, convergent surface into the freeboard at a plurality of spaced locations and to a common depth determined by reference to the path, whereby the notches are formed.

BEST MODE FOR CARRYING OUT THE INVENTION

Figure 2:
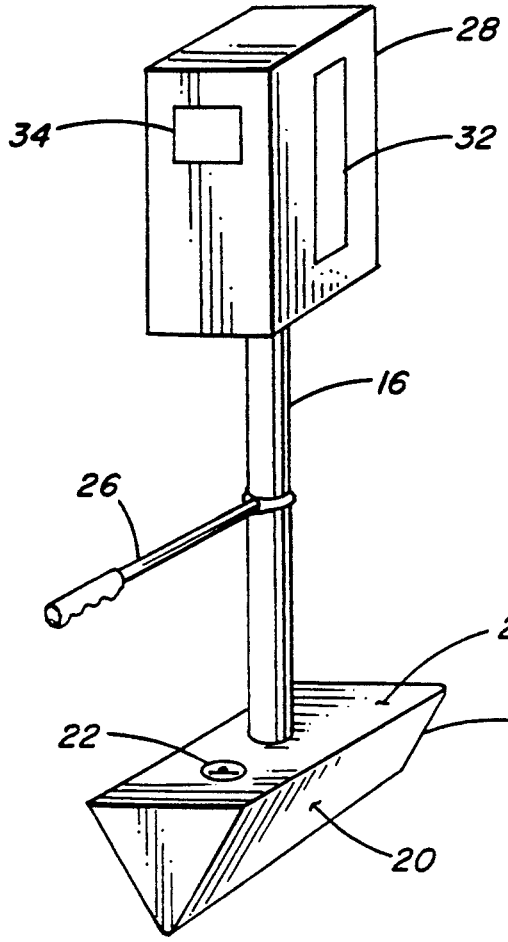
FIG. 2 is a perspective view of a device which may be used in forming the notches illustrated in FIG. 1.

FIG. 2 illustrates the device I typically use in forming the notches 14. A rigid shaft 16 is rigidly fixed to a rigid base member 18. The base member 18 has an outer surface 20 which is conformal with the desired shape of the notches 14. Generally, though not necessarily, the notches are V-shaped. A conventional level indicator 22 is rigidly fixed to the top portion 24 of the outer surface 20 so the user can ensure that the notches 14 converge in a consistent direction. To facilitate handling, a handle 26 is rigidly but adjustably secured to the shaft 16 as indicated. Rigidly fixed near the top of the shaft 16 is an electrooptic receiver 28 suitable for use with a construction laser 30 (FIGS. 4). The receiver 28 includes a detection window 32 through which radiation propagated from the laser 30 is received, and further includes a visual indicator 34 by which proper depth for the notches 14 is determined. The construction laser 30 is a commercially available device adapted to propagate radiation along a planar path by use of a laser source contained in a rotating structure; and it includes means for determining whether the propagation plane is ninety degrees from the direction of the gravitational vector. Suitable lasers 30 and receivers 28 can be obtained from SPECTRA-PHYSICS of Dayton, Ohio, and are available through various distributors of agricultural and construction equipment.

Figure 3:
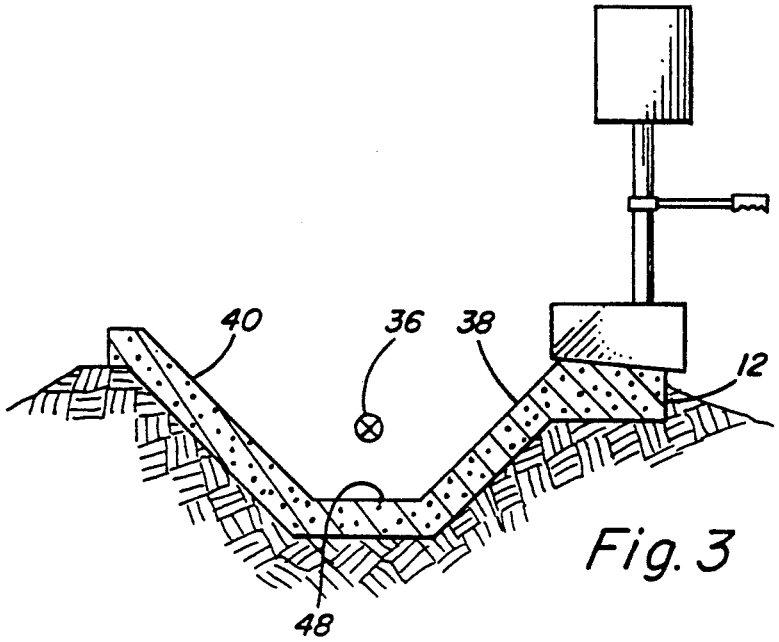
FIG. 3 is a cross-section of the lateral illustrated in FIG. 1, and shows the device of FIG. 2 depressed into the freeboard of the lateral.
Figure 4A:
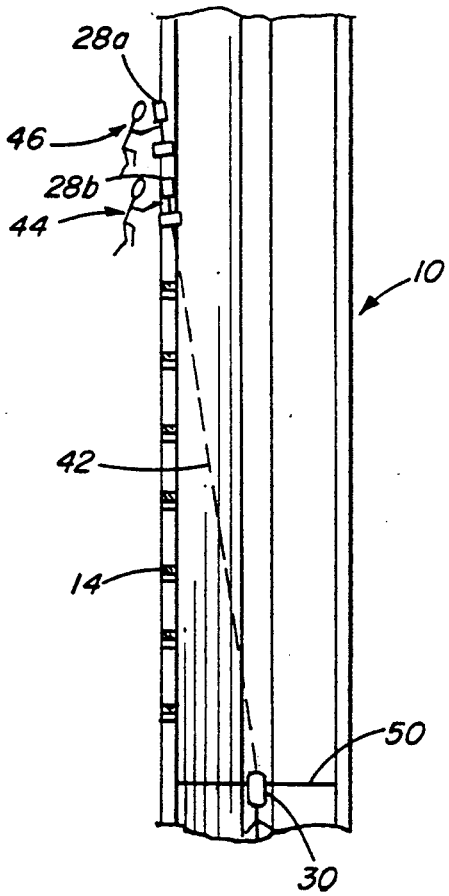
Fig. 4A PRIOR ART
FIGS. 4*a* and 4*b* are partial plan views, somewhat schematic, of notched irrigation laterals. The drawings illustrate placement of a laser device used in the inventive process.

Referring now to FIG. 4*a*, the obvious location at which to position the laser 30 is at the center of the lateral 10 (i.e., along the longitudinal 36 of the lateral). That placement provides the following two advantages. First, most of the lateral 10 is below ground level. Therefore, the tripod or other structure that supports the laser 30 is protected from instability which may result from windy conditions. Second, the side-walls 38, 40 (FIG. 3) of the lateral provide a ready means for supporting the structure that in turn supports the laser 30. However, I have found such placement to be unsatisfactory for reasons I shall now describe with reference to the drawing, in which the dashed line 42 indicates the path of radiation from the laser 30 to a distal receiver 28*a*.

The process by which the concrete lateral 10 is formed may vary. However, in any such process, the curing rate of the concrete imposes certain limitations. The most important limitation pertaining to this invention is that two or more persons must be employed to form the notches 14. These two persons each use a device such as that illustrated in FIG. 2 to form the notches 14 in alternating fashion. If the laser 30 is positioned as shown in FIG. 4*a*, the person 44 negrer the laser is apt to block the radiation path 42 leading to the receiver 28*a*, either bodily or by use of the receiver 28*b*. The problem worsens as the persons 44, 46 progress away from the laser 30. This impedes progress in formation of the notches 14. To the degree that this impediment slows formation of the lateral 10, it also slows the entire operation by which the lateral 10 is formed.

Figure 4B:
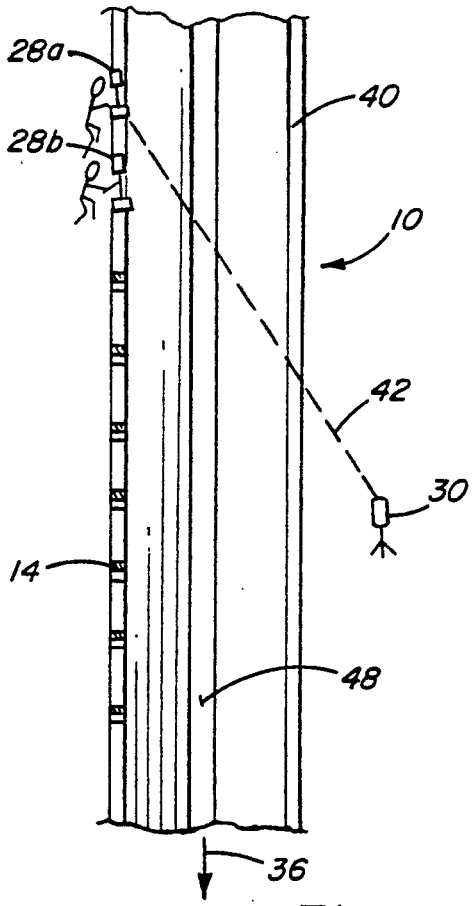

I find it preferable to locate the laser 30 at a position such as that illustrated in FIG. 4*b*, despite sacrifice of the above-described advantages. As illustrated in FIG. 4*b*, the laser 30 is preferably positioned at a location spaced from the lateral 10 and across the axis 36 from the freeboard 12 in which the notches 14 are formed. In general, it is preferable to position the laser as far from the lateral 10 as is practical given the grade of the adjacent terrain and the range limitations of the laser-receiver combination employed. Alternatively, the laser 30 may be secured atop the side wall 40 while still providing considerable improvement over the configuration illustrated in FIG. 4*a*. In addition, because the bottom surface 48 of the lateral 10 is hardened where the laser 30 is located in FIG. 4*a*, and because it is insufficiently wide to ensure stability with the use of a tripod, a bridging structure 50 is required to stabilize the laser. Setup in that arrangement requires three persons, whereas setup as illustrated in FIG. 4*b* requires only one person.

Figure 1:
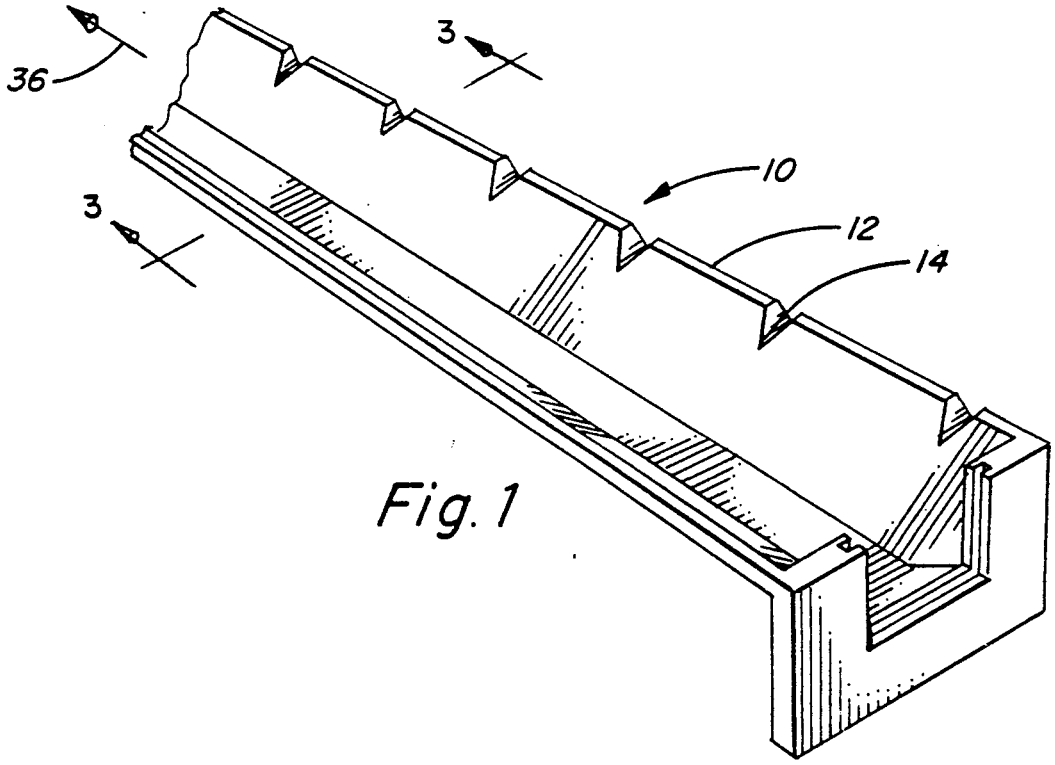
FIG. 1 is a partial perspective view of a notched irrigation lateral.

In accord with the above, the laser 30 is positioned as indicated, and at a height consistent with the chosen depth of the notches 14. The laser 30 is then activated to propagate radiation along a substantially planar path. With the laser activated, the surface 20 of the base member 18 is depressed into the freeboard 12 (see FIG. 3), while the latter is uncured, this forming a notch 14. The notches 14 are thus formed at a plurality of spaced locations as illustrated in FIG. 1, with the spacing being selected by the farmer for whom the lateral 10 is formed.

The foregoing description, which includes the accompanying drawings, is intended as illustrative rather than restrictive. The invention should be construed in accord with the following claims.

I claim:

1. A process for forming notches of common depth in an uncured freeboard of an irrigation lateral, comprising the steps of:

positioning a laser device adapted to propagate radiation along a substantially planar path so that the path is at an angle of about ninety degrees relative to the direction of a gravitational vector determined at the location of the device; the device being positioned such that the longitudinal axis of the lateral is located between the freeboard and the device;

activating the device to propagate the radiation along the path; and depressing a rigid, convergent surface into the freeboard at a plurality of spaced locations and to a common depth determined by reference to the path, whereby the notches are formed.

2. A process as recited in claim 1 wherein the device is positioned such that the device is spaced from the lateral, as determined by orthogonal, vertical projection.

3. A process as recited in claim 1 wherein the device is positioned atop a side wall of the lateral, the axis extending parallel to the side wall; the side wall and the notches being positioned on opposite sides of the axis.

* * * * *